US012751500B2

(12) United States Patent
Jensen et al.

(10) Patent No.: US 12,751,500 B2
(45) Date of Patent: Oct. 6, 2026

(54) CLERICAL GARMENT DEVICE

(71) Applicants: William Jensen, Normal, IL (US); Cynthia Jensen, Normal, IL (US)

(72) Inventors: William Jensen, Normal, IL (US); Cynthia Jensen, Normal, IL (US)

( * ) Notice: Subject to any disclaimer, the term of this patent is extended or adjusted under 35 U.S.C. 154(b) by 56 days.

(21) Appl. No.: 19/046,281

(22) Filed: Feb. 5, 2025

(65) Prior Publication Data

US 2026/0223957 A1 Aug. 6, 2026

(51) Int. Cl.
*A41B 1/08* (2006.01)

(52) U.S. Cl.
CPC ..... *A41B 1/08* (2013.01)

(58) Field of Classification Search
CPC .... A41D 13/1209; A41D 27/18; A41D 27/16; A41B 3/18; A41B 3/00; A41B 1/12; A41B 3/005
USPC ..... 2/69
See application file for complete search history.

(56) References Cited

U.S. PATENT DOCUMENTS 2,102,198 A * 12/1937 Dickman ..... A41B 3/04 2/127
3,206,764 A 9/1965 Toomey
3,486,170 A 12/1969 Rochon
3,860,967 A * 1/1975 Tedesco ..... A41B 3/00 2/139
5,001,785 A * 3/1991 Heiman ..... A41D 27/10 2/114
5,572,740 A * 11/1996 Geniesse ..... A45D 44/08 2/46
5,953,753 A * 9/1999 Perez ..... A45D 44/08 2/48
6,070,542 A * 6/2000 Wong ..... A41D 27/24 112/475.09
8,151,371 B2 * 4/2012 Carpentier ..... A62B 17/003 2/81
2017/0231288 A1 * 8/2017 Tesser ..... A41B 3/00 2/243.1
2018/0035722 A1 2/2018 Wilson, II
2020/0297038 A1 * 9/2020 Carlino ..... A41D 1/04

FOREIGN PATENT DOCUMENTS

GB 1271511 4/1972

* cited by examiner

*Primary Examiner* — Timothy K Trieu

(57) ABSTRACT

A clerical garment device includes a shirt that has a body and a pair of sleeves. The shirt has a neck opening to extend around a neck of the user when the user is wearing the shirt. A collar is coupled to the shirt and the collar is continuously arcuate such that the collar defines a closed loop. The collar extends around a full circumference of the neck opening such that the collar extends around the neck of the user when the user is wearing the shirt. The shirt has a dark color and the collar has a light color with respect to the dark color of the shirt such that the collar presents the visual appearance of a clerical collar when the user is wearing the shirt.

6 Claims, 5 Drawing Sheets

CLERICAL GARMENT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to clerical devices and more particularly pertains to a new clerical device for wearing by a user who is performing liturgical duties. The device includes a shirt that has a neck opening and a collar that is coupled to the shirt. The collar forms a closed loop that extends around a full circumference of the neck opening. The shirt has a dark color and the collar has a light collar such that the collar presents the appearance of a clerical collar when the user is wearing the shirt.

(2) Description of Related Art Including Information Disclosed Under 37 CFR 1.97 and 1.98

The prior art relates to clerical devices including: a clerical garment that includes a shirt that has a channel integrated into a neck opening of the shirt and a clerical collar that is insertable into the channel; a variety of clerical garment devices that each at least includes a shirt with a neck opening and a collar that is removably attachable to itself to form a closed loop and fasteners to removably attach the collar to the shirt; a clerical garment device that includes a shirt which has a inner neck band and an outer neck band and a collar that is coupled between the inner neck band and the outer neck band. In no instance does the prior art disclose a clerical garment device that includes a shirt that has a neck opening and a collar that is sewn to the shirt such that the collar extends around a full circumference of the neck opening.

BRIEF SUMMARY OF THE INVENTION

An embodiment of the disclosure meets the needs presented above by generally comprising a shirt that has a body and a pair of sleeves. The shirt has a neck opening to extend around a neck of the user when the user is wearing the shirt. A collar is coupled to the shirt and the collar is continuously arcuate such that the collar defines a closed loop. The collar extends around a full circumference of the neck opening such that the collar extends around the neck of the user when the user is wearing the shirt. The shirt has a dark color and the collar has a light color with respect to the dark color of the shirt such that the collar presents the visual appearance of a clerical collar when the user is wearing the shirt.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
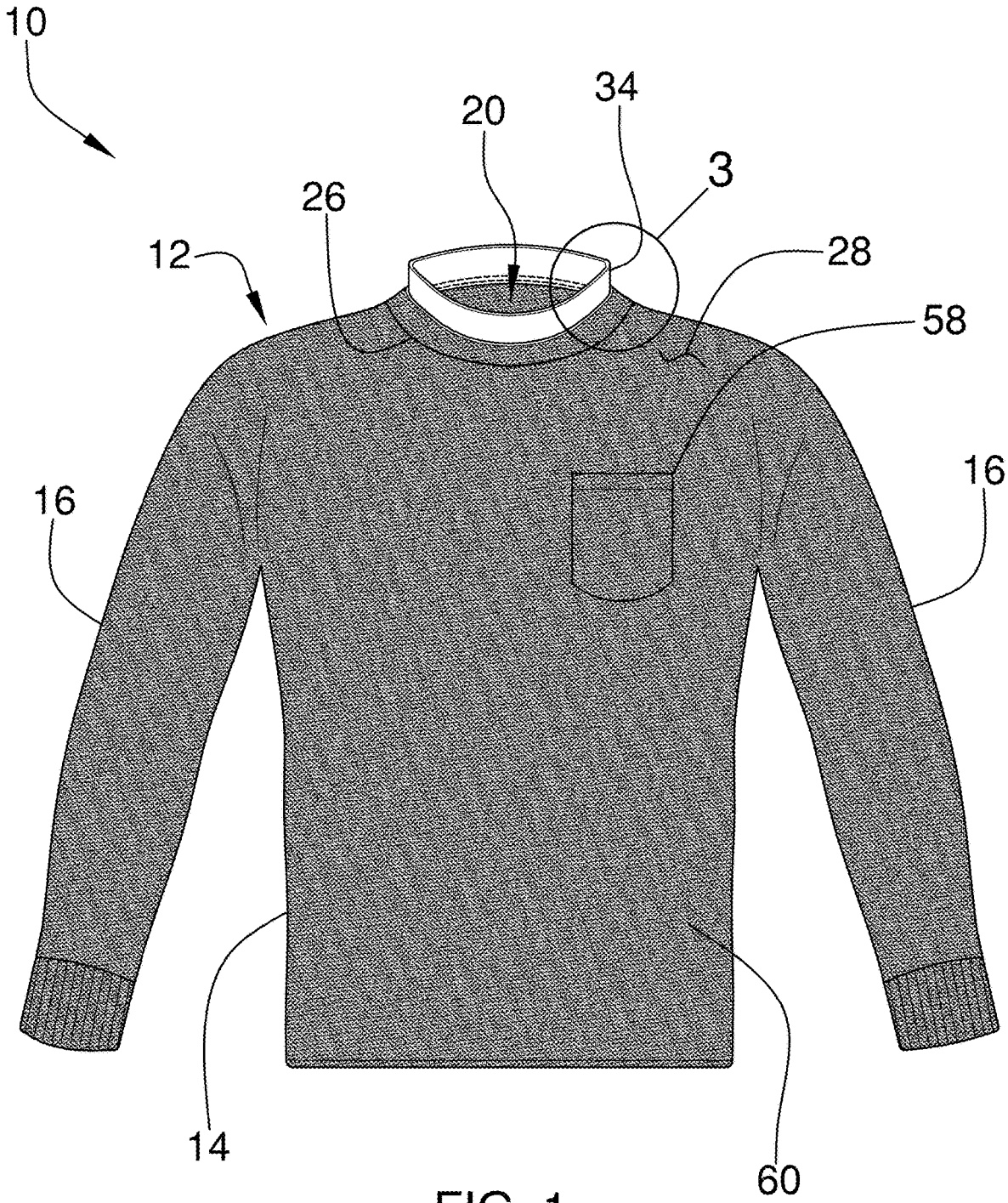
FIG. 1 is a front view of a clerical garment device according to an embodiment of the disclosure.
Figure 2:
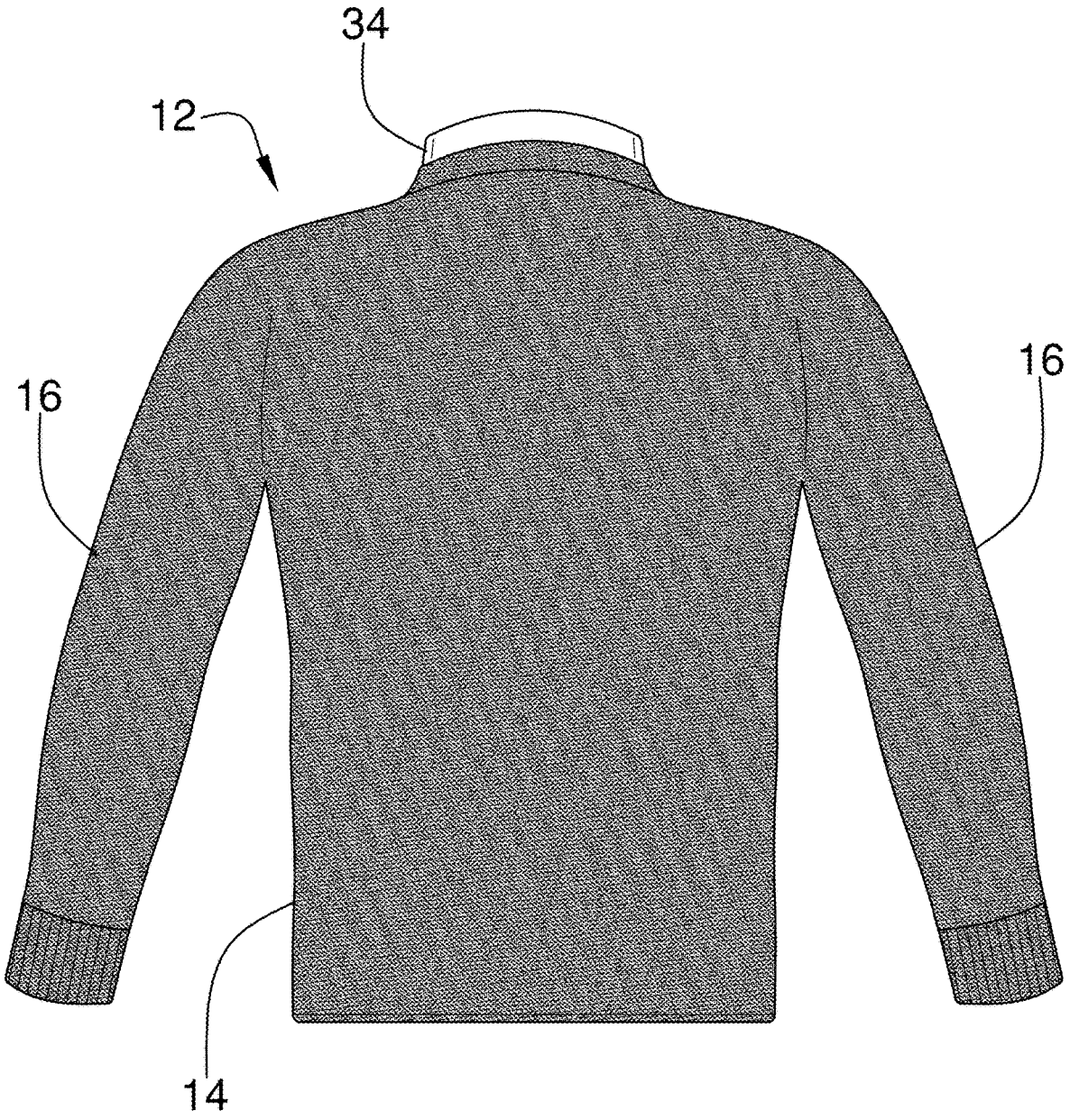
FIG. 2 is a back view of an embodiment of the disclosure.
Figure 3:
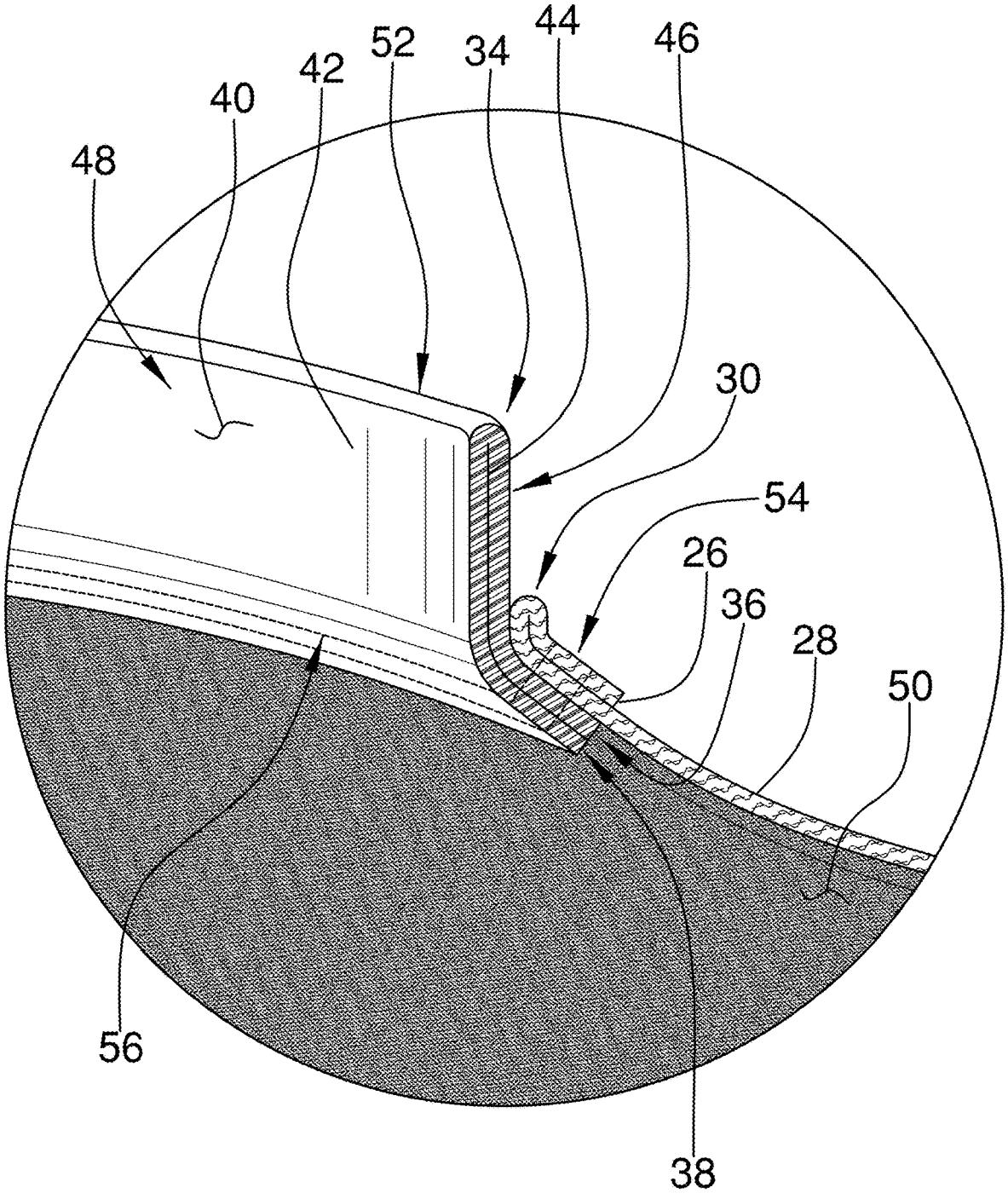
FIG. 3 is a magnified cut-away view taken from circle 3 of FIG. 1 of an embodiment of the disclosure.
Figure 4:
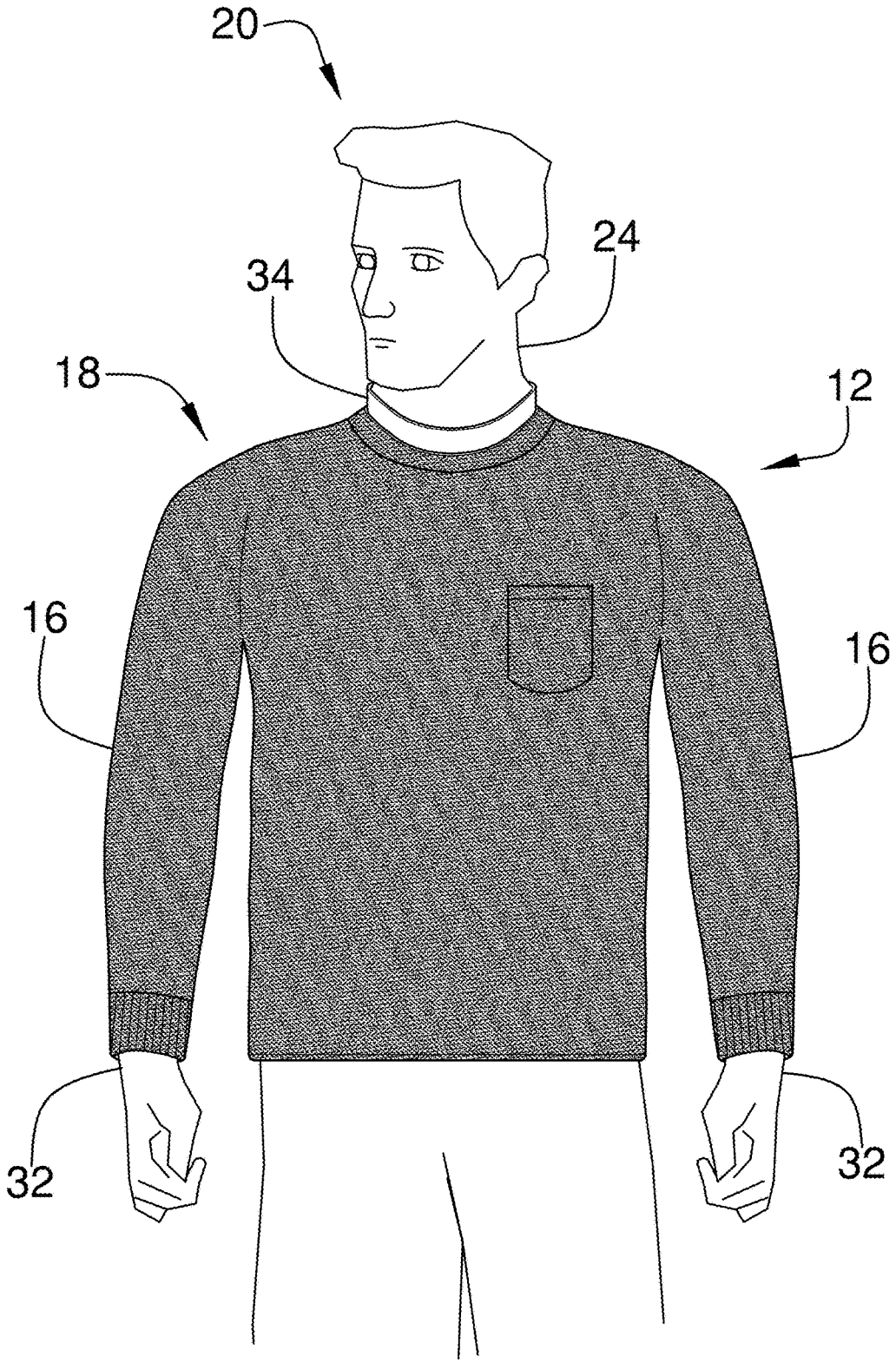
FIG. 4 is a perspective in-use view of an embodiment of the disclosure.
Figure 5:
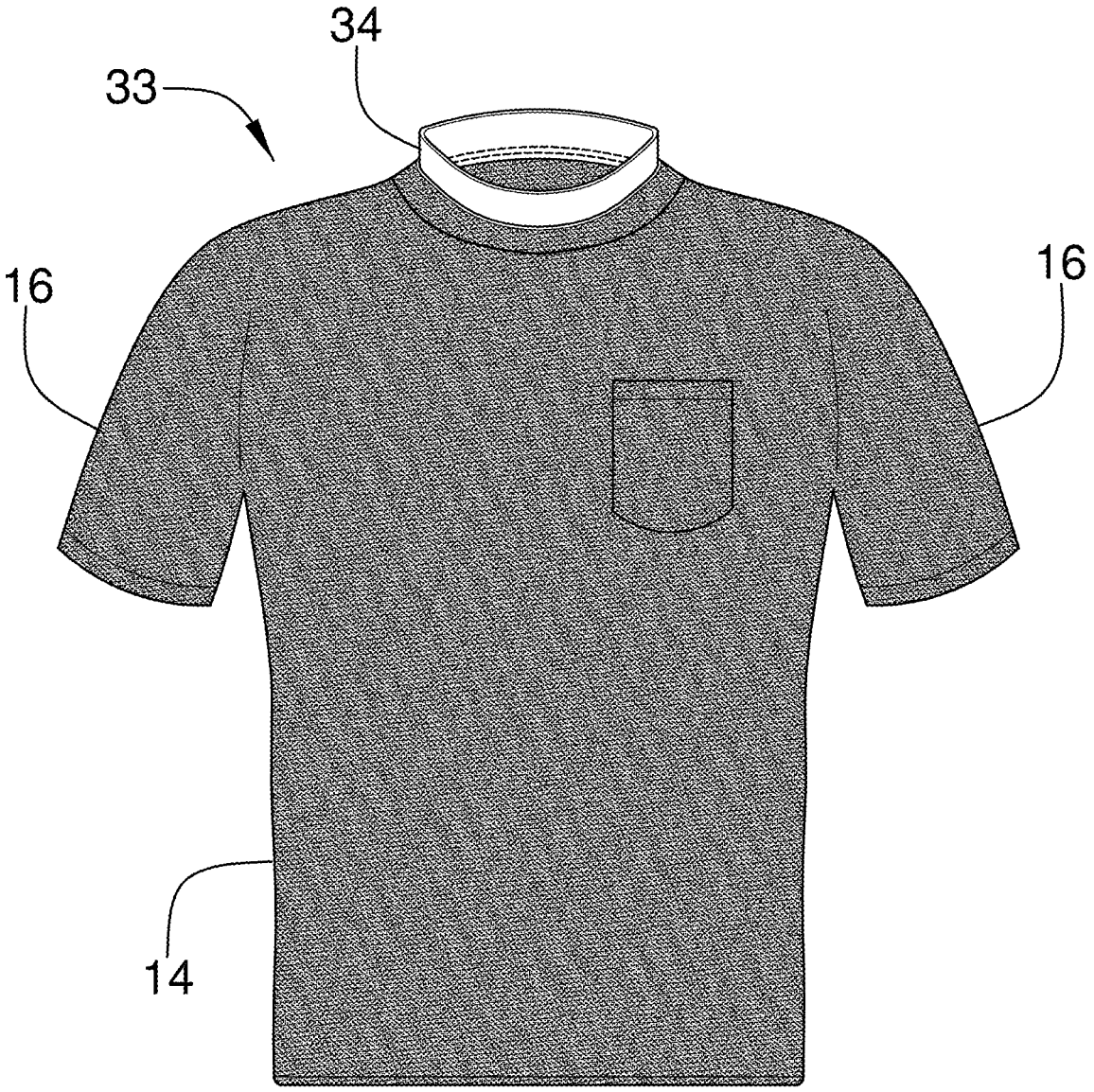
FIG. 5 is a perspective view of an alternative embodiment of the disclosure.

With reference now to the drawings, and in particular to FIGS. 1 through 5 thereof, a new clerical device embodying the principles and concepts of an embodiment of the disclosure and generally designated by the reference numeral 10 will be described.

As best illustrated in FIGS. 1 through 5, the clerical garment device 10 generally comprises a shirt 12 that has a body 14 and a pair of sleeves 16 such that the shirt 12 is configured to be worn on an upper body 18 of a user 20. The user 20 may be a pastor, a priest or other cleric that performs public service of a religious nature. The shirt 12 has a neck opening 22 that is centrally located between the pair of sleeves 16 and the neck opening 22 extends around a neck 24 of the user 20 when the user 20 is wearing the shirt 12. The neck opening 22 has a bounding edge 26 and the shirt 12 has an outside surface 28. The shirt 12 is folded onto itself around the neck opening 22 to define a fold 30 in the shirt 12 that is spaced from the bounding edge 26. Additionally, the bounding edge 26 of the neck opening 22 lies on the outside surface 28 such that the bounding edge 26 of the neck opening 22 visually presents an ornamental feature of the shirt 12. Each of the sleeves 16 may be long sleeves that have a length sufficient to extend along a full length of arms 32 of the user 20. In an alternative embodiment 33 shown in FIG. 5, each of the sleeves 16 may be short sleeves that extend along a partial length of the arms 32 of the user 20.

A collar 34 is coupled to the shirt 12 and the collar 34 is continuously arcuate about a central point such that the collar 34 defines a closed loop. The collar 34 extends around a full circumference of the neck opening 22 such that the collar 34 extends around the neck 24 of the user 20 when the user 20 is wearing the shirt 12. The shirt 12 has a dark color, including but not being limited to black or navy blue, and the collar 34 has a light color with respect to the dark color of the shirt 12, including but not being limited to white or grey. Furthermore, the collar 34 presents the visual appearance of a clerical collar 34 when the user 20 is wearing the shirt 12.

The collar 34 has a top edge 36 and a bottom edge 38 and an outer surface 40 extending between the top edge 36 and the bottom edge 38; the outer surface 40 has a front side 42 and a back side 44. The collar 34 is folded onto itself having the top edge 36 being aligned with the bottom edge 38 to define a first half 46 of the collar 34 and a second half 48 of the collar 34. The front side 42 of the outer surface 40 corresponding to first half 46 lies against the front side 42 of the outer surface 40 corresponding to the second half 48. The shirt 12 has an inside surface 50 and the back side 44 of the outer surface 40 corresponding to the first half 46 of the collar 34 rests against the inside surface 50 of the shirt 12.

The collar 34 has a fold 52 in the collar 34 which is centrally located between the top edge 36 and the bottom edge 38. Additionally, the fold 52 in the collar 34 is spaced upwardly from the fold 30 in the shirt 12. Each of the top edge 36 and the bottom edge 38 is aligned with the bounding edge 26 of the neck opening 22. The fold 30 in the shirt 12 defines an outer layer 54 of the shirt 12 which extends between the bounding edge 26 of the neck opening 22 and the fold 30 in the shirt 12. Additionally, the outer layer 54 of the shirt 12 rests on the body 14 of the shirt 12. The collar 34 is coupled to the shirt 12 with stitching 56 and the stitching 56 extends through the outer layer 54 of the shirt 12 and the body 14 of the shirt 12 and the first half 46 of the collar 34 and the second half 48 of the collar 34. Furthermore, the collar 34 is stitched to the shirt 12 such that the collar 34 is a unitary component of the shirt 12. A pocket 58 may be sewn into a front side 60 of the body 14 of the shirt 12 and the pocket 58 may be offset from a center of the front side 60 of the body 14 of the shirt 12.

In use, the user 20 wears the shirt 12 when the user 20 is performing the liturgical duties, such as officiating a wedding or ministering to a congregation. The collar 34 is attached to the shirt 12 as a unitary structure with the stitching 56 rather than being removably attachable with buttons or snaps that can be uncomfortable for the user 20. Additionally, the shirt 12 is worn in a pullover fashion rather than needing to be buttoned or zipped to increase the convenience for the user 20. The shirt 12 can be worn beneath a blazer or a jacket or in combination with any other types of clothing, depending on the preference of the user 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A clerical garment device comprising:

a shirt having a body and a pair of sleeves wherein said shirt is configured to be worn on an upper body of a user, said shirt having a neck opening being centrally located between said pair of sleeves wherein said neck opening is configured to extend around a neck of the user when the user is wearing said shirt;

a collar being coupled to said shirt, said collar being continuously arcuate about a central point such that said collar defines a closed loop, said collar extending around a full circumference of said neck opening wherein said collar is configured to extend around the neck of the user when the user is wearing said shirt, said shirt having a dark color, said collar having a light color with respect to said dark color of said shirt wherein said collar is configured to present the visual appearance of a clerical collar when the user is wearing said shirt;

wherein said collar has a top edge and a bottom edge and an outer surface extending between said top edge and said bottom edge;

wherein said outer surface has a front side and a back side;

wherein said collar is folded onto itself having said top edge being aligned with said bottom edge to define a first half of said collar and a second half of said collar;

wherein said front side of said outer surface corresponding to first half lies against said front side of said outer surface corresponding to said second half;

wherein said shirt has an inside surface; and wherein said back side of said outer surface corresponding to said first half of said collar rests against said inside surface of said shirt.

2. The clerical garment device according to claim 1, wherein:

said neck opening has a bounding edge;

said shirt has an outside surface;

said shirt is folded onto itself around said neck opening; and said bounding edge of said neck opening lies on said outside surface wherein said bounding edge of said neck opening is configured to visually present an ornamental feature of said shirt.

3. The clerical garment device according to claim 1, wherein:

said neck opening in said shirt has a bounding edge;

said shirt is folded onto itself around said neck opening to define a fold in said shirt being spaced from said bounding edge;

said collar has a fold in said collar being centrally located between said top edge and said bottom edge;

said fold in said collar is spaced upwardly from said fold in said shirt.

4. The device according to claim 3, wherein each of said top edge and said bottom edge is aligned with said bounding edge of said neck opening.

5. The clerical garment device according to claim 1, wherein:

said neck opening in said shirt has a bounding edge;

said shirt is folded onto itself around said neck opening to define a fold in said shirt being spaced from said bounding edge;

said fold in said shirt defines an outer layer of said shirt extending between said bounding edge of said neck opening and said fold in said shirt; and said outer layer of said shirt rests on said body of said shirt;

said collar is folded onto itself to define a first half of said collar and a second half of said collar;

said collar is coupled to said shirt with stitching; and said stitching extends through said outer layer of said shirt and said body of said shirt and said first half of said collar and said second half of said collar.

6. A clerical garment device comprising:

a shirt having a body and a pair of sleeves wherein said shirt is configured to be worn on an upper body of a user, said shirt having a neck opening being centrally located between said pair of sleeves wherein said neck opening is configured to extend around a neck of the user when the user is wearing said shirt, said neck opening having a bounding edge, said shirt having an outside surface, said shirt being folded onto itself around said neck opening to define a fold in said shirt being spaced from said bounding edge, said bounding edge of said neck opening lying on said outside surface wherein said bounding edge of said neck opening is configured to visually present an ornamental feature of said shirt; and a collar being coupled to said shirt, said collar being continuously arcuate about a central point such that said collar defines a closed loop, said collar extending around a full circumference of said neck opening wherein said collar is configured to extend around the neck of the user when the user is wearing said shirt, said shirt having a dark color, said collar having a light color with respect to said dark color of said shirt wherein said collar is configured to present the visual appearance of a clerical collar when the user is wearing said shirt, said collar having a top edge and a bottom edge and an outer surface extending between said top edge and said bottom edge, said outer surface having a front side and a back side, said collar being folded onto itself having said top edge being aligned with said bottom edge to define a first half of said collar and a second half of said collar, said front side of said outer surface corresponding to first half lying against said front side of said outer surface corresponding to said second half, said shirt having an inside surface, said back side of said outer surface corresponding to said first half of said collar resting against said inside surface of said shirt, said collar having a fold in said collar being centrally located between said top edge and said bottom edge, said fold in said collar being spaced upwardly from said fold in said shirt, each of said top edge and said bottom edge being aligned with said bounding edge of said neck opening, said fold in said shirt defining an outer layer of said shirt extending between said bounding edge of said neck opening and said fold in said shirt, said outer layer of said shirt resting on said body of said shirt, said collar being coupled to said shirt with stitching, said stitching extending through said outer layer of said shirt and said body of said shirt and said first half of said collar and said second half of said collar.

* * * * *